United States Patent [19]

Dickakian

[11] 4,219,404

[45] Aug. 26, 1980

[54] VACUUM OR STEAM STRIPPING AROMATIC OILS FROM PETROLEUM PITCH

[75] Inventor: Ghazi Dickakian, Scotch Plains, N.J.

[73] Assignee: Exxon Research & Engineering Co., Florham Park, N.J.

[21] Appl. No.: 48,507

[22] Filed: Jun. 14, 1979

[51] Int. Cl.[2] ..... C10C 3/00

[52] U.S. Cl. ..... 208/39; 208/22; 208/44; 423/447.1

[58] Field of Search ..... 208/39, 22, 44; 423/447.1

[56] References Cited

U.S. PATENT DOCUMENTS

| | | | |
|---|---|---|---|
| 3,318,801 | 5/1967 | Alexander et al. | 208/22 |
| 3,617,515 | 11/1971 | Bloomer | 208/131 |
| 3,794,579 | 2/1974 | Enomoto et al. | 208/22 |
| 3,839,190 | 10/1974 | Frese et al. | 208/44 |
| 3,919,376 | 11/1975 | Schulz | 423/447.4 |
| 3,919,387 | 11/1975 | Singer | 423/447.4 |
| 3,966,584 | 6/1976 | Gray | 208/8 |
| 3,974,264 | 10/1976 | McHenry | 208/39 |
| 4,005,183 | 1/1977 | Singer | 208/44 |
| 4,017,327 | 4/1977 | Lewis et al. | 423/447.4 |
| 4,026,788 | 5/1977 | McHenry | 208/39 |
| 4,032,430 | 6/1977 | Lewis | 208/39 |
| 4,036,736 | 7/1977 | Ozaki | 208/106 |
| 4,042,486 | 8/1977 | Asano et al. | 208/39 |
| 4,049,538 | 9/1977 | Hayashi | 208/50 |

*Primary Examiner*—Veronica O'Keefe

*Attorney, Agent, or Firm*—Joseph J. Dvorak

[57] ABSTRACT

The present invention contemplates a process for preparing a feedstock for carbon artifact manufacture comprising treating a carbonaceous pitch, which has at least a portion of the polycondensed aromatic oils normally present in the pitch removed, at temperatures in the range generally of from about 350° C. to about 450° C. and for times ranging from several minutes to about 10 hours. Optionally an isotropic carbonaceous pitch is heated at temperatures in the range of about 350° to about 450° C. while simultaneously vacuum stripping the pitch to remove at least a portion and generally greater than 40% of the aromatic oils in the pitch thereby simultaneously removing the aromatic oils from the pitch while conducting the heat treatment.

9 Claims, No Drawings

VACUUM OR STEAM STRIPPING AROMATIC OILS FROM PETROLEUM PITCH

FIELD OF THE INVENTION

This subject invention is concerned generally with the preparation of a feedstock for carbon artifact manufacture from carbonaceous residues of petroleum origin including distilled or cracked residuum of crude oil and hydrodesulfurized residues of distilled or cracked crude oil.

DESCRIPTION OF THE PRIOR ART

Carbon artifacts have been made by pyrolyzing a wide variety of organic materials. One carbon artifact of commercial interest today is carbon fiber; hence, particular reference is made herein to carbon fiber technology. Nonetheless, it should be appreciated that this invention has applicability to carbon artifact formation generally and most particularly to the production of shaped carbon articles in the form of filaments, yarns, films, ribbons, sheets and the like.

Referring now in particular to carbon fibers, suffice it to say that the use of carbon fibers in reinforcing plastic and metal matrices has gained considerable commercial acceptance where the exceptional properties of the reinforcing composite materials such as their higher strength to weight ratio clearly offset the generally high costs associated with preparing them. It is generally accepted that large-scale use of carbon fibers as a reinforcing material would gain even greater acceptance in the marketplace if the costs associated with the formation of the fibers could be substantially reduced. Thus, the formation of carbon fibers from relatively inexpensive carbonaceous pitches has received considerable attention in recent years.

Many carbonaceous pitches are known to be converted at the early stages of carbonization to a structurally ordered optically anisotropic spherical liquid called mesophase. The presence of this ordered structure prior to carbonization is considered to be a significant determinant of the fundamental properties of any carbon artifact made from such a carbonaceous pitch. Indeed, the ability to generate high optical anisotropicity during processing is accepted particularly in carbon fiber production as a prerequisite to the formation of high quality products. Thus, one of the first requirements of any feedstock material suitable for carbon artifact manufacture and particularly carbon fiber production is its ability to be converted to a highly optically anisotropic material.

In addition to being able to develop a highly ordered structure suitable feedstocks for carbon artifact manufacture and particularly carbon fiber manufacture should have relatively low softening points, rendering them suitable first being deformed and shaped into desirable articles. Thus, in carbon fiber manufacture, a suitable pitch which is capable of generating the requisite highly ordered structure must also exhibit sufficient viscosity for spinning. Unfortunately, many carbonaceous pitches have relatively high softening points. Indeed, incipient coking frequently occurs in such materials at temperatures where they have sufficient viscosity for spinning. The presence of coke, however, or other infusable materials and/or undesirably high softening point components generated prior to or at the spinning temperatures are determental to processability and are believed to be detrimental to product quality.

Thus, for example, U.S. Pat. No. 3,919,376 discloses the difficulty in deforming pitches which undergo coking and/or polymerization near their softening temperatures.

Another important characteristic of a feedstock for carbon artifact manufacture is its rate of conversion to a suitable optically anisotropic material. For example, in the above-mentioned U.S. Patent, it is disclosed that 350° C. is the minimum temperature generally required to produce mesophase from a carbonaceous pitch. More importantly, however, is the fact that at least one week of heating is necessary to produce a mesophase content of about 40% at that minimum temperature. Mesophase, of course, can be generated in shorter times by heating at higher temperatures. However, as indicated above, at temperatures particularly in excess of about 425° C., incipient coking and other undesirable side reactions do take place which can be detrimental to the ultimate product quality.

In copending application Ser. No. 903,172, filed May 5, 1978, it has been disclosed that typical graphitizable carbonaceous pitches contain a separable fraction which possesses very important physical and chemical properties insofar as carbon fiber processing is concerned. Indeed, the separable fraction of typical graphitizable carbonaceous pitches exhibits a softening range or viscosity suitable for spinning and has the ability to be converted at temperatures in the range generally of about 230° C. to about 400° C. to an optically anisotropic deformable pitch containing greater than 75% of the liquid crystalline type structure. Unfortunately, the amount of separable fraction present in well known commercially available graphitizable pitches such as Ashland 240 and Ashland 260, to mention a few, is exceedingly low. For example, with Ashland 240, no more than about 10% of the pitch constitutes a separable fraction capable of being thermally converted to a liquid crystalline phase.

In copending patent application Ser. No. 903,717, filed May 5, 1978, it has been disclosed that the amount of that fraction of typical graphitizable carbonaceous pitches that exhibits a softening point and viscosity which is suitable for spinning and has the ability to be rapidly converted at low temperatures to highly optically anisotropic deformable pitch can be increased by heat soaking the pitch, for example at temperatures in the range of 350° C. to 450° C., until spherules visible under polarized light begin to appear in the pitch. The heat soaking of such pitches has generally resulted in an increase in the amount of the fraction of the pitch capable of being converted to an optically anisotropic phase. Indeed, yields up to about 48% of a separable phase were obtained upon heat treatment of the Ashland 240, for example.

SUMMARY OF THE INVENTION

It has now been discovered that polycondensed aromatic oils present in isotropic carbonaceous feedstocks and particularly isotropic carbonaceous graphitizable pitches are generally detrimental to the rate of formation of highly optically anisotropic material in such feedstocks when being heated at elevated temperatures. Moreover, it has been discovered that such polycondensed aromatic oils can be readily removed by techniques such as vacuum or steam stripping and the like. Heat soaking such pitches in which have at least a portion of the amount of aromatic oils removed results in high yields of a feedstock suitable in carbon artifact manufacture.

Succinctly stated, then, the present invention contemplates a process for preparing a feedstock for carbon artifact manufacture comprising treating a carbonaceous pitch, which has removed therefrom at least a portion of the polycondensed aromatic oils normally present in the pitch, at temperatures in the range generally of from about 350° C. to about 450° C. and for times ranging from several minutes to about 10 hours. Optionally, an isotropic carbonaceous pitch is heated at temperatures in the range of about 350° C. to about 450° C. while simultaneously vaccum stripping the pitch to remove at least a portion of the aromatic oils, thereby simultaneously removing the aromatic oils from the pitch while conducting the heat treatment.

Full appreciation and all ramifications of the present invention will be more readily understood upon a reading of the detailed description which follows.

DETAILED DESCRIPTION OF THE INVENTION

The term "pitch" as used herein means highly aromatic petroleum pitches and pitches obtained as by-products in the gas oil or naphtha cracking industry, pitches of high carbon content obtained from petroleum cracking and other substances having properties of aromatic pitches produced as by-products in various industrial chemical processes.

The term "petroleum pitch" refers to the residuum carbonaceous material obtained from the thermal, steam and catalytic cracking of petroleum distillates including hydrodesulfurized residuum of distilled and cracked crude oils.

Generally, pitches having a high degree of aromaticity are suitable for carrying out the present invention. So, too, are high boiling, highly aromatic streams containing such pitches or that are capable of being converted into such pitches. Specifications for a typical cat cracker bottom that would be suitable in the practice of the invention are given in Table I:

TABLE I

| | |
|---|---|
| Physical Characteristics | |
| Coking Value (yield at 55° C.) | 7.0%-14.0% |
| Specific Gravity at 15° C. | 1.0-1.15 |
| Viscosity at 210° F. (cps) | 0.5-25 |
| Pour Point | −5° C.-+20° C. |
| Ash Content | 0.02%-0.30% |
| Chemical Characteristics | |
| Aromatic Carbon (by NMR) | 48%-90% |
| Carbon/Hydrogen Atomic Ratio | 0.94-1.15 |
| Solvent Insolubles | |
| n-Heptane Insolubles | 0.1%-20% |
| Toluene Insolubles | 0.05%-0.25% |
| Molecular Weight | |
| Average Molecular Weight (Mn) | 200-300 |
| Elemental Analysis | |
| Carbon | 86%-92% |
| Hydrogen | 4.0%-5.5% |
| Sulfur | 0.05%-5.0% |
| Characteristics of the Asphaltene | |
| Average Molecular Weight (Mn) | 500-1000 |
| Coking Value of Asphaltene at 550° C. | 55%-65% |

Also meeting the general requirements of high aromaticity and high carbon content are those commercially available petroleum pitches which are known to form mesophase in substantial amounts during heat treatment at elevated temperatures. Thus, for example, commercially available pitches such as Ashland 240 and Ashland 260 are suitable pitches for use in the practice of the present invention.

As previously indicated, it has been discovered that such pitches contain an aromatic oil which is believed to be detrimental to the rate of formation of the highly optical anisotropic phase when such pitches are heated at elevated temperatures, for example at temperatures above about 350° C. Therefore, according to one embodiment of the present invention, oil containing, isotropic carbonaceous pitches are first treated so as to remove at least a portion of the amount of oil normally present in such pitches. Indeed, the oil removed should be in an amount sufficient to enhance the rate of formation of a highly optically anisotropic material when such pitch is heated at temperatures above about 350° C. Generally, the pitch is treated so as to remove greater than 40% and especially from about 40% to about 90% of the total amount of the oil present in the pitch; however, in some instances, it may be desirable to remove substantially all of the oil from the pitch. Preferably, from about 65% to about 80% of the oil in the pitch is removed.

One technique for satisfactorily removing at least a portion of the oil from the pitch requires treating the isotropic carbonaceous pitch under reduced pressure and at temperatures below the cracking temperature of the pitch. For example, the pitch is heated to temperatures in the range of about 250° C. to about 380° C. while applying vacuum to the pitch, in the range of 0.1 to 25 millimeters Hg pressure. After at least a part, for example from 40% to 90%, of the oil has been removed, the pitch is then heat soaked at atmospheric pressure in an inert atmosphere, such as nitrogen, for example, at temperatures in the range from about 350° C. to about 450° C. and preferably at temperatures in the range of about 380° C. to about 400° C. for about 5 minutes to 10 hours.

In an alternate embodiment of the present invention, the carbonaceous isotropic pitch is heated at temperatures in the range generally of 350° C. to 450° C. and preferably at 380° C. to 400° C. for five minutes to about 10 hours while maintaining the so-heated pitch under reduced pressures of, for example, between 0.1 to about 25 millimeters Hg pressure. Thus, the pitch is effectively vacuum stripped and heat soaked simultaneously.

After heat treating the pitch in the manner set forth in the embodiments above, the pitch can be used directly in carbon artifact manufacture. Optionally and preferably, however, the pitch is subsequently treated with a solvent as disclosed in U.S. Ser. No. 903,171, filed May 5, 1978 and incorporated herein by reference. Thus, after removing at least a portion of the oil from the isotropic carbonaceous pitch and heat soaking in either sequential or simultaneous operation, the pitch is preferably treated with a solvent, or mixture of solvents, which will result in the separation of a solvent insoluble fraction of the pitch which is highly anisotropic or capable of being converted to a highly anisotropic phase and which has a softening point and viscosity at temperatures in the range of about 250° C. to about 400° C. which is suitable for spinning. Typically, such solvent, or mixture of solvents, includes aromatic hydrocarbons such as benzene, toluene, xylene and the like and mixtures of such aromatic hydrocarbons with aliphatic hydrocarbons such as toluene/heptane mixtures. The solvents or mixtures of solvents typically will have a solubility parameter of between 8.0 and 9.5 and preferably between about 8.7 and 9.2 at 25° C. The solubility parameter $\gamma$ of a solvent or mixture of solvents is given by the expression $$\gamma=(H_v-RT/V)^{\frac{1}{2}}$$

where $H_v$ is the heat of vaporization of the material, R is the molar gas constant, T is the temperature in °K. and V is the molar volume. In this regard, see, for example, J. Hildebrand and R. Scott, "Solubility of Non-Electrolytes", 3rd edition, Reinhold Publishing Company, N.Y. (1949) and "Regular Solutions", Prentice Hall, N.J. (1962). The solubility parameters at 25° for hydrocarbons in commercial $C_6$–$C_8$ solvents are as follows: benzene, 8.2; toluene, 8.9; xylene, 8.8; n-hexane, 7.3; n-heptane, 7.4; methyl cyclohexane, 7.8; bis-cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred having greater than about 60 volume % toluene, such as 60% toluene/40% heptane and 85% toluene/15% heptane.

The amount of solvent employed will be sufficient to provide a solvent insoluble fraction which is capable of being thermally converted to greater than 75% of an optically anisotropic material in less than 10 minutes. Typically, the ratio of solvent to pitch will be in the range of from about 5 milliliters to about 150 milliliters of solvent to gram of pitch.

After heating with the solvent, the solvent insoluble fraction can be readily separated by techniques such as sedimentation, centrifugation, filtration and the like. Any of the solvent insoluble fraction of the pitch prepared in accordance with the process of the present invention is eminently suitable for carbon fiber production.

A more complete understanding of the process of this invention can be obtained by reference to the following examples which are illustrative only and are not meant to limit the scope thereof which is fully disclosed in the hereafter appended claims.

EXAMPLES 1 and 2

Seventy pounds of a commercially available aromatic petroleum pitch (Ashland 240) were introduced into a heat soaker which was electrically heated and equipped with a mechanical agitator. The charge of pitch was heated in one run at 390° C. for varying time periods and in a second run at 400° C. for varying time periods. The amount of toluene insoluble material present in the pitch was determined as follows:

(1) Forty grams of crushed sample were mixed for 18 hours at room temperature with 320 ml of toluene and the mixture was thereafter filtered using a 10–15μ fritted glass filter.

(2) The filter cake was washed with 80 ml of toluene, reslurried and mixed for 4 hours at room temperature with 120 ml of toluene, filtered using a fritted glass filter.

(3) The filtered cake was washed with 80 ml of toluene, followed by a wash with 80 ml of heptane.

(4) Finally, the solid was dried at 120° C. in vacuum for 24 hours.

The above method for determining toluene insolubles is hereinafter referred to as the SEP technique which is an acronym for standard extraction procedure.

The softening point of the toluene insoluble fraction is given in Table II below. Additionally, optical anisotropicity of the pitch was determined by first heating the pitch to its softening point and then, after cooling, placing a sample of the pitch on a slide with Permount, a histological mounting medium sold by Fisher Scientific Company, Fairlawn, N.J. A slip cover was placed over the slide and by rotating the cover under hand pressure, the mounted sample was crushed to a powder and evenly dispersed on the slide. Thereafter, the crushed sample was viewed under polarized light at a magnification factor of 200X and the percent optical anisotropicity was estimated.

As is shown in Table II below, heat soaking of petroleum pitch does result in an increase of the fraction of the pitch which displays anisotropicity.

TABLE II

Atmospheric Heat Soaking Of Petroleum Pitch

| Example | Conditions Temp (°C.) | Conditions Time (hr) | Toluene Insolubles (by SEP) % | Toluene Insolubles (by SEP) MP (°C.) | Optical Activity (%) | Quinoline Insolubles % (1) |
|---|---|---|---|---|---|---|
| 1 | 390 | 0 | 14.6 | 300 | — | — |
| | | 1 | 15.4 | 325 | — | — |
| | | 2 | 17.1 | 325 | — | — |
| | | 3 | 20.7 | 325 | — | — |
| | | 4 | 21.0 | 325 | 100 | 0.35 |
| 2 | 400 | 0 | 12.1 | 325 | — | — |
| | | 1 | 18.1 | 325 | — | — |
| | | 2 | 18.3 | 325 | 100 | 0.30 |

(1) Quinoline insolubles were determined by the standard ASTM test method of extraction with quinoline at 75° C.

EXAMPLES 3 to 5

In the following examples, a commercially available aromatic petroleum pitch containing 25% of polycondensed aromatic oils (Ashland 240) was stripped by heating under reduced pressure (20 to 25 inches Hg) to remove the aromatic oil from the pitch. At 390° C. and 25 inches Hg, 17 wt. % of a yellowish aromatic distillate, or 68% of the total amount of aromatic oil present in the pitch, was removed. The remaining pitch was then heat soaked and treated as described in Examples 1 and 2. The conditions and results are set forth essentially in Table III below.

TABLE III

ATMOSPHERIC HEAT SOAKING OF VACUUM STRIPPED PITCH

| Example | Heat Soaking Conditions Temp (°C.) | Heat Soaking Conditions Time (hr) | Toluene Insolubles (SEP) % | Toluene Insolubles (SEP) MP (°C.) | Optical Activity (%) | Quinoline Insolubles, (%) (1) |
|---|---|---|---|---|---|---|
| 3 | 390 | 0 | 22.6 | 325 | — | — |
| | | 1 | 29.8 | 325 | — | 1.4 |
| | | 2 | 32.9 | 325 | — | 2.2 |
| | | 3 | 36.2 | 325 | — | 3.0 |
| | | 4 | 39.5 | 325 | 100 | 3.2 |
| 4 | 400 | 0 | 22.7 | 325 | — | 0.70 |
| | | 1 | 30.6 | 325 | — | 0.85 |
| | | 2 | 34.2 | 325 | — | 1.35 |
| | | 3 | 37.7 | 325 | 100 | 2.8 |
| 5 | 410 | 0 | 25.3 | 325 | — | — |
| | | 1 | 33.4 | 325 | — | — |
| | | 2 | 39.9 | 325 | — | — |
| | | 3 | 45.4 | 325 | 100 | 7.4 |

(1) Quinoline insolubles were determined by the standard ASTM test method of extraction with quinoline at 75° C.

EXAMPLES 6 and 7

Seventy pounds of a petroleum pitch (Ashland 240) were introduced into a heat soaker which was electrically heated and equipped with a mechanical agitator. The charge was heated at 390° C. and 400° C. under a reduced pressure of 25 inches mercury until 20 wt. % of an aromatic oil, or 80% of the total amount of oil in the pitch, was removed. Heat soaking was continued under reduced pressure with the results described in Table IV below:

TABLE IV

| VACUUM HEAT SOAKING | | | | | | |
|---|---|---|---|---|---|---|
| | Heat Soaking Conditions | | Toluene Insolubles (SEP) | | | |
| Example | Temp (°C.) | Time (hr) | % | MP (°C.) | Optical Activity (%) | Quinoline Insolubles, (%) (1) |
| 6 | 400 | 0 | 29.9 | 325 | — | 1.8 |
| | | 1 | 38.4 | 325 | — | 2.1 |
| | | 2 | 45.3 | 325 | — | 2.6 |
| | | 3 | 51.8 | 325 | 100 | 5.1 |
| 7 | 390 | 0 | 24.5 | 325 | — | — |
| | | 1 | 27.8 | 325 | — | — |
| | | 2 | 36.7 | 325 | — | — |
| | | 3 | 40.5 | 325 | 100 | 2.0 |

(1) Quinoline insolubles were determined by the standard ASTM test method of extraction with quinoline at 75° C.

EXAMPLE 8

In this example, an intermediate petroleum pitch prepared from a cat cracker bottom having the following characteristics:

| | |
|---|---|
| Softening point, °F. | 210 |
| Coking value at 550° C. | 55% |
| Toluene Insoluble reflux method, % | 3.5–7.0 |
| Quinoline Insolubles, % | 0.1–0.5 |
| CH atomic ratio | 1.42 |
| Aromatic Carbon, atom % | 82–85 |

was subjected to stripping under reduced pressure to remove about 20 volume % of an oil without cracking or thermally treating the pitch. Maximum bottom temperature of the reactor was 293° C. and the pressure over the heated pitch was 0.5 mm Hg.

The vacuum stripped pitch was then heat soaked at atmospheric pressures and various times, and the toluene insolubles were extracted as outlined generally above. Table V gives the details.

TABLE V

| Example | Heat Soak Temp (°C.) | Heat Soak Time (hr) | Toluene Insolubles (SEP) Yield, % | Softening Point | Anisotropicity |
|---|---|---|---|---|---|
| 8 | 415 | 3 | 12.3 | 375° C. | 100% |
| 9 | 430 | 3 | 37.5 | 375° C. | 100% |
| 10 | 380 | 3 | 36.3 | 325° C. | 100% |
| 11 | 400 | 1 | 29.5 | 350° C. | 100% |

EXAMPLE 9

In this example, 20 tons of an aromatic feedstock (cat cracker bottom) were vacuum stripped in a 7500 gallon reactor by heating the feed gradually up to 400° C. After all the distillable oils were removed, the remaining pitch residue was heat treated at 400° C. for 5.0 hours under reduced pressure (25 in. Hg). Samples of the pitch were obtained hourly and analyzed. Table VI gives the details.

TABLE VI

| PLANT PRODUCTION OF PITCH FROM CAT CRACKER BOTTOM | | |
|---|---|---|
| Heat Soaking Time (hr) | Ti Insolubles (SEP), % | Pitch Soft Point (°C.) |
| 1.0 | 6.0 | 52 |
| 2.0 | 8.8 | 74 |
| 3.0 | 12.2 | 86 |
| 4.0 | 15.4 | 95 |
| 5.0 | 21.2 | 107 |
| product after cooling | 24.0 | 111 |

What is claimed is:

1. A process for preparing a feedstock capable of being converted into a deformable pitch containing greater than 75% of an optically anisotropic phase comprising: removing from 40% to 90% of the aromatic oils present in isotropic carbonaceous residues of petroleum origin by vacuum or steam stripping and thereafter heat soaking the balance of the residue at temperatures in the range of 350° C. to 450° C. for times ranging generally from about 5 minutes to 10 hours.

2. The process of claim 1 wherein the vacuum of steam stripping and heat soaking are conducted simultaneously.

3. In the process of preparing an isotropic carbonaceous pitch suitable for carbon artifact manufacture, from a carbonaceous residue of petroleum origin, the improvement comprising heat soaking said carbonaceous residue at temperatures in the range of from about 350° C. to 450° C. for times ranging from 5 minutes to 10 hours at pressures below about 25 inches mercury, whereby at least 40% to 90% of the aromatic oils present in said carbonaceous residue of petroleum origin is removed therefrom and an isotropic carbonaceous pitch capable of being converted to an optically anisotropic phase is obtained.

4. A process for treating a thermal or cracked residuum of a petroleum or chemical origin capable of being thermally converted to an optically anisotropic phase comprising: heating said residuum at an elevated temperature and at a reduced pressure, whereby 40% to 90% of the aromatic oil contained in said residuum is removed, said temperature and said pressure being sufficient for removal of said aromatic oil in said pitch without thermal transformation of the balance of said residuum; containing the heating of said so treated residuum at temperatures in the range of about 350° C. to about 450° C. for about 5 minutes to about 10 hours; treating said heated pitch with an organic solvent system having a solubility parameter at 25° C. of between about 8.0 and 9.5, said treating being at a temperature and with an amount of organic solvent system sufficient to provide a solvent insoluble fraction which is thermally convertible into a deformable pitch containing greater than 75% of an optically anisotropic phase.

5. The process of claim 4 wherein said elevated temperature and reduced pressure at which said pitch is heated to remove said aromatic oil is in the range of from about 250° C. to about 380° C. at 0.1 to 25 mm Hg pressure.

6. The process of claim 4, wherein said continued heating of said pitch is at reduced pressure.

7. The process of claim 6 wherein the pressure is in the range of 1 to 50 inches of mercury.

8. The process of claim 5 wherein said continued heating of said pitch is at atmospheric pressure and in an inert atmosphere.

9. The process of claim 8 wherein the inert atmosphere is nitrogen.

* * * * *